US006106258A

United States Patent [19]

Kajiwara et al.

[11] Patent Number: 6,106,258

[45] Date of Patent: Aug. 22, 2000

[54] HIGH-PRESSURE DOME TYPE COMPRESSOR CAPABLE OF PREVENTING OIL DISCHARGE DUE TO GAS AND OF COOLING OIL BY DISCHARGE GAS

[75] Inventors: Mikio Kajiwara; Yoshitaka Shibamoto, both of Osaka, Japan

[73] Assignee: Daikin Industries, Ltd., Osaka, Japan

[21] Appl. No.: 09/029,580

[22] PCT Filed: Aug. 1, 1996

[86] PCT No.: PCT/JP96/02168

§ 371 Date: Mar. 6, 1998

§ 102(e) Date: Mar. 6, 1998

[87] PCT Pub. No.: WO97/09534

PCT Pub. Date: Mar. 13, 1997

[30] Foreign Application Priority Data

Sep. 8, 1995 [JP] Japan ..... 7-231607

[51] Int. Cl.[7] ..... F04C 15/00

[52] U.S. Cl. ..... 418/188; 418/57.1; 418/57.6; 418/94

[58] Field of Search ..... 418/57.1, 57.6, 418/94, 188

[56] References Cited

U.S. PATENT DOCUMENTS 4,928,503 5/1990 Riffe ..... 62/498
5,040,952 8/1991 Inoue et al. ..... 417/312
5,224,848 7/1993 Noburu et al. ..... 418/55.1

FOREIGN PATENT DOCUMENTS 0 480 065 A1 4/1992 European Pat. Off. .
60-224988 11/1985 Japan .
63-057388 U 4/1988 Japan .
4-012182 1/1992 Japan .

*Primary Examiner*—Thomas Denion
*Assistant Examiner*—Theresa Trieu
*Attorney, Agent, or Firm*—Birch, Stewart, Kolasch & Birch, LLP

[57] ABSTRACT

A high-pressure dome type compressor is capable of successfully cooling oil fed to sliding portions during a passage of oil in a drive shaft by discharge gas without causing the oil to be discharged along with the gas. In the drive shaft of a motor disposed in a casing and a moveable scroll of a compression section driven by the drive shaft, there are defined discharge gas passages for discharging, into the casing, compressed fluid compressed in a compression chamber of the compression element. An oil feed passage for oil pumped up from an oil reservoir at a bottom of the casing is defined in the drive shaft so as to be partitioned from the discharge gas passage.

9 Claims, 2 Drawing Sheets

HIGH-PRESSURE DOME TYPE COMPRESSOR CAPABLE OF PREVENTING OIL DISCHARGE DUE TO GAS AND OF COOLING OIL BY DISCHARGE GAS

This application is the national phase under 35 U.S.C. §371 of prior PCT International Application No. PCT/JP 96/02168 which has an International filing date of Aug. 1, 1996 which designated the United States of America, the entire contents of which are hereby incorporated by reference.

TECHNICAL FIELD

The present invention relates to a high-pressure dome type compressor in which a motor and a compression section to be driven by a drive shaft are disposed within a high-pressure dome type closed casing.

BACKGROUND ART

Conventionally, there has been known a high-pressure dome type compressor as disclosed in, for example, Japanese Patent Laid-Open Publication No. SHO 60-224988. In this high-pressure dome type compressor, a suction pipe is connected to a compression section, compressed gas compressed by the compression section is once discharged into the casing and then discharged out of the casing via an outside discharge pipe.

More specifically, in the conventional high-pressure dome type compressor, as shown in FIG. 2, a compression section E comprising a fixed scroll B fixed to a housing A disposed in a casing F and a movable scroll D to be driven by a drive shaft C of a motor M is internally provided airtight within the closed casing F. A suction pipe G is connected to the fixed scroll B, and a discharge port H opened into the casing F is defined in the fixed scroll B.

In the movable scroll D, there is defined a boss D1 to which is fitted an eccentric shaft portion C1 of the drive shaft C that is connected to the motor M, so that the movable scroll D will be eccentrically rotated as the drive shaft C rotates. The drive shaft C is supported with a bearing by the housing A, while oil in an oil reservoir J at the bottom of the casing F is pumped up through an oil feed passage C2 defined in the drive shaft C so as to be fed to the bearing portion and boss D1's sliding portion of the housing A.

Then, gas sucked from the suction pipe G into the compression section E is compressed in a compression chamber K defined between the scrolls B, D, then discharged into the casing F through the discharge port H defined at the center of the fixed scroll B, and thereafter discharged out of the casing F via an outside discharge pipe L.

For the conventional high-pressure dome type compressor, there is a need of cooling oil because the oil fed to the bearing portion through the oil feed passage C2 of the drive shaft C, which has become high in temperature due to frictional heat, is returned to the oil reservoir J of the casing F. However, the cooling of oil in the oil reservoir J is usually implemented merely by naturally cooling only the surface of the oil reservoir J by heat exchange with the discharge gas which has been discharged into the casing F, not by aggressively cooling the oil enough. Thus, there has been a problem in that seizure may occur to the sliding portions.

In operating ranges in which the amount of refrigerant circulation decreases, there has been another problem that oil cannot be cooled up by discharge gas so that the oil becomes an abnormally high temperature, causing a deterioration of the oil.

As a solution for this, it might be conceived to implement the cooling of oil by aggressively putting the discharge gas into contact with the surface of the oil reservoir. With this solution applied, however, the oil would be disturbed by the discharge gas being blown against the oil reservoir, resulting in a problem of so-called oil rise that the oil is discharged along with gas.

The present invention has been developed in view of the above described problems and has for its essential object to provide a high-pressure dome type compressor capable of successfully cooling the oil fed to sliding portions by implementing heat exchange between the discharge gas and the oil fed to the sliding portions, without causing any oil rise.

DISCLOSURE OF THE INVENTION

The present invention provides a high-pressure dome type compressor in which a compression section having a fixed scroll and a movable scroll as well as a motor having a drive shaft for driving the movable scroll of the compression section are disposed in a closed casing, the high-pressure dome type compressor being characterized in that: discharge gas passages for discharging, into the closed casing, compressed gas compressed in a compression chamber of the compression section are defined in the movable scroll and the drive shaft, respectively, and an oil feed passage for oil pumped up from an oil reservoir located at a bottom of the closed casing is defined in the drive shaft so as to be partitioned from the discharge gas passage.

According to the present invention, heat exchange between discharge gas flowing through the discharge gas passage and oil flowing through the oil feed passage is carried out so that the oil within the oil feed passage to be supplied to the bearing and other sliding portions can be successfully cooled by the discharge gas within the discharge gas passage. Still, since the discharge gas passage and the oil feed passage are defined so as to be partitioned from each other, any disturbance of oil due to discharge gas can be prevented so that the cooling of oil can be accomplished successfully without causing any oil rise.

Furthermore, since heat exchange between discharge gas and oil is successfully carried out, the temperature difference between discharge gas temperature and oil temperature can be minimized so that the state of oil can be determined based on the discharge gas temperature. Thus, the control of oil temperature is facilitated.

When a large quantity of refrigerant is mixed in low-temperature oil, for example, at a start of the compressor, the oil within the oil feed passage can be heated by the discharge gas flowing through the discharge gas passage. Therefore, gas can be separated from the oil by a heating process before the oil is fed to the lubricating portions, so that the viscosity of oil can be increased and thus the lubrication performance can be improved.

In an embodiment, the discharge gas passage of the drive shaft is provided so as to be eccentric with respect to an axis of the drive shaft, in an eccentric direction of the movable scroll driven by the drive shaft.

According to this embodiment, the discharge gas passage is provided in such a direction that any imbalance of the movable scroll is canceled. Therefore, the balance weight provided to the drive shaft may be smaller than the conventional, so that the compressor can be designed to be lighter in weight.

In an embodiment, a discharge pipe is opened to a first space defined between the compression section and the motor while the discharge gas passage of the drive shaft is opened to a second space defined on a side of the motor opposite to a side of the motor on which the compression section is provided.

According to this embodiment, discharge gas discharged from the discharge gas passage is discharged out of the casing through the discharge pipe, after it has cooled the motor. Therefore, the cooling of the motor can be aggressively fulfilled by the discharge gas discharged from the discharge gas passage. Still, during the cooling of the motor, oil in the discharge gas is separated so that the oil rise can be prevented more successfully.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

BEST MODE FOR CARRYING OUT THE INVENTION

Figure 1:
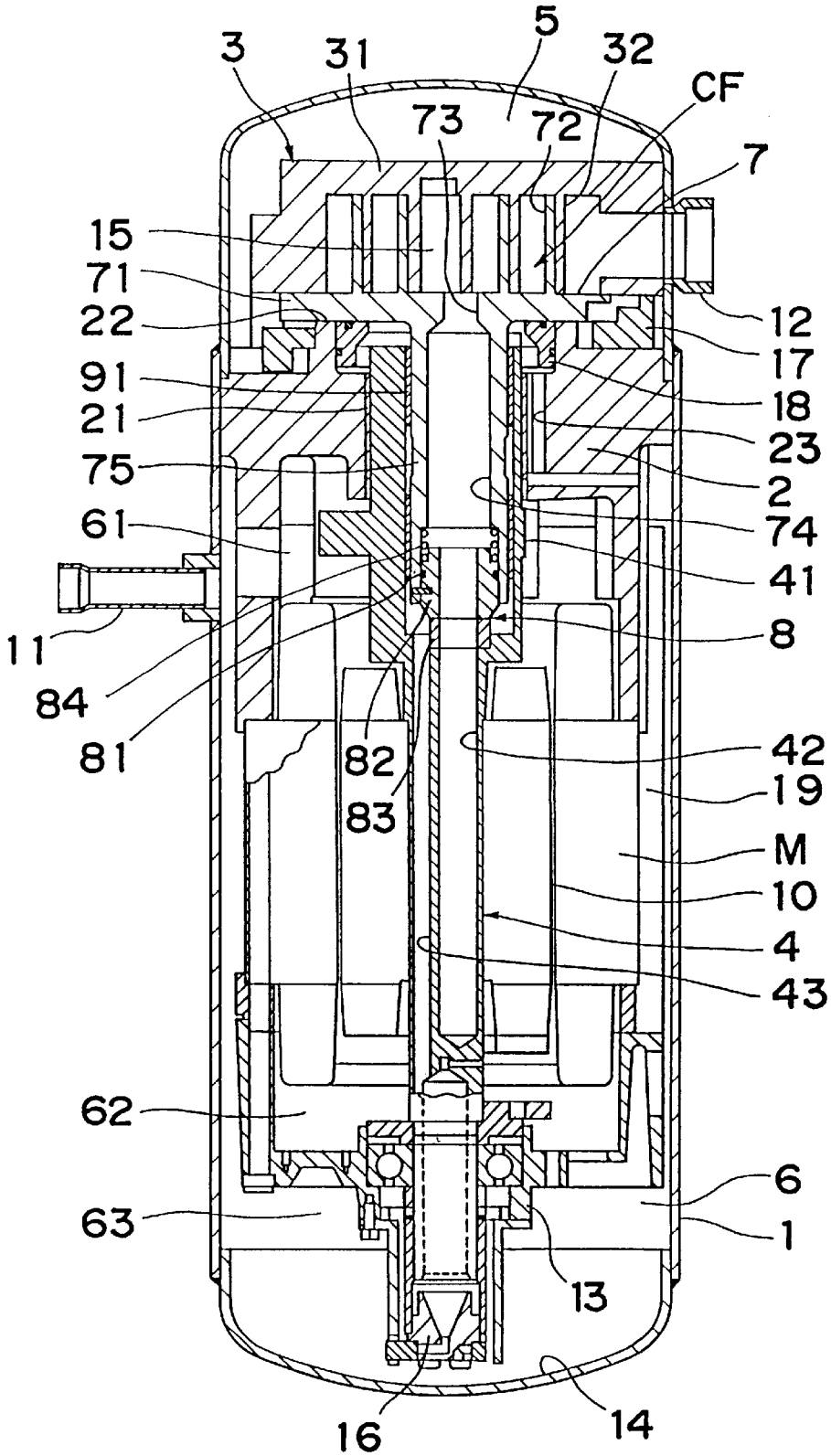
FIG. 1 is a longitudinal sectional view of one embodiment of the high-pressure dome type compressor according to a present invention.
Figure 2:
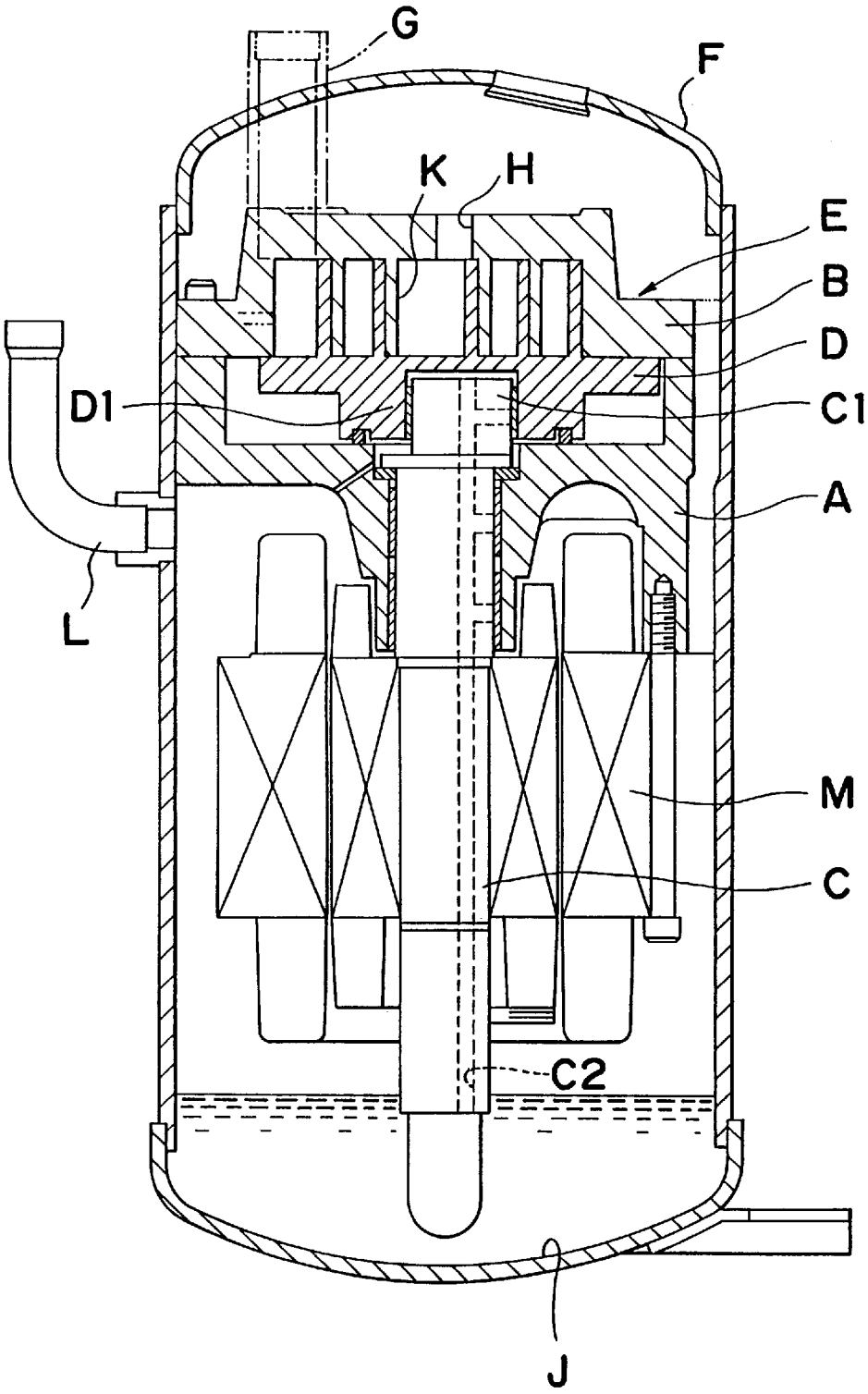
Fig. 2 Conventional Art
FIG. 2 is a sectional view showing a conventional high-pressure dome type compressor.

FIG. 1 is a high-pressure dome type scroll compressor showing an embodiment of the present invention. In the scroll compressor, a housing 2 is fixed to a closed casing 1, a compression section CF is disposed above the housing 2, and a fixed scroll 3 of the compression section CF is fixed to the housing 2. On the other hand, a motor M for driving the compression section CF is disposed below the housing 2, and a drive shaft 4 of the motor M is held to a bearing portion 21 of the housing 2.

Further, the housing 2 serves for the partition into a low-pressure side chamber 5 where the compression section CF is disposed and a high-pressure side chamber 6 where the motor M is disposed and a discharge pipe 11 is opened so that compressed gas compressed by the compression section CF is discharged. A suction pipe 12 connects directly with the fixed scroll 3. The high-pressure side chamber 6 is divided into a first space 61 defined by the motor M between the motor M and the compression section CF, a second space 62 defined by the motor M and a cup-like pump housing 13 on a side of the motor M opposite to a side of the motor M on which the compression section is provided, and a third space 63 having an oil reservoir 14 and defined below the pump housing 13.

The compression section CF comprises a movable scroll 7 which has a spiral member 72 protrudingly provided to an end plate 71 and which is connected to the drive shaft 4 of the motor M, and the fixed scroll 3 which has a spiral member 32 protrudingly provided to an end plate 31. These scrolls 7, 3 are oppositely provided so that their spiral members 72, 32 engage each other, where a compression chamber 15 is defined between the spiral members 72, 32.

In the movable scroll 7, a discharge port 73 for discharging compressed gas compressed in the compression chamber 15 is defined at a central portion of the end plate 71 of the movable scroll 7, while a cylindrical portion 75 having a discharge gas passage 74 to which the discharge port 73 opens is provided to a rear-side central portion of the end plate 71.

In the drive shaft 4, an eccentric boss 41 for receiving the cylindrical portion 75 of the movable scroll 7 is defined, while further provided are a discharge gas passage 42 one end of which is communicated with the discharge gas passage 74 of the cylindrical portion 75 via a communicating member 8 and the other end of which is opened to the second space 62 defined on the underside of the motor M in the closed casing 1, and an oil feed passage 43 one end of which is opened into the eccentric boss 41 and the other end of which is communicated with the oil reservoir 14 provided at the bottom of the casing 1 via an oil pump 16. The discharge gas passage 42 and the oil feed passage 43 are partitioned and defined in parallel to each other. This discharge gas passage 42 is communicated with the second space 62 through an unshown hole.

The communicating member 8 comprises a seal member 82 which is insertionally fitted into the cylindrical portion 75 of the movable scroll 7 so as to be unrotatable and axially movable relative to the cylindrical portion 75 via a ring seal 81, and a sliding bushing 83 which will slide in contact with the seal member 82 and which is pressed and secured into the eccentric boss 41 of the drive shaft 4. Between the seal member 82 and the cylindrical portion 75, there is interposed a coil spring 84 for urging the seal member 82 against the sliding bushing 83, by which the seal member 82 and the sliding bushing 83 are sealed from each other so that the gas within the discharge gas passages 74, 42 will not leak into the eccentric boss 41.

The drive shaft 4 is supported at its lower side by the pump housing 13. The oil pump 16 is a positive displacement type oil pump.

The discharge gas passage 42 formed in the drive shaft 4 is made larger in diameter than the oil feed passage 43, and provided so as to be eccentric with the axis of the drive shaft 4 in the eccentric direction of the movable scroll 7.

Between the movable scroll 7 and the housing 2, an Oldham's ring 17 is provided so that the movable scroll 7 is enabled to orbit without rotating itself.

Further, the rear side of the end plate 71 of the movable scroll 7 is supported by an annular thrust receiving portion 22 defined in the housing 2. The thrust receiving portion 22 is located inner than the Oldham's ring 17. At the inner radius of the thrust receiving portion 22, a cylindrical seal ring 18 is further provided to contact with the end plate 71 of the movable scroll 7. By the seal ring 18, a spatial portion defined on the inner radius side of the seal ring 18 is partitioned from the low-pressure side chamber 5.

Oil pumped up through the oil feed passage 43 is once pumped up into the eccentric boss 41, lubricating a bearing 91 provided between the outer circumferential surface of the cylindrical portion 75 of the movable scroll 7 and the inner circumferential surface of the eccentric boss 41, as well as the bearing portion 21 supporting the outer circumferential surface of the eccentric boss 41, while the oil is fed also to the place where the seal ring 18 is provided. The oil after effecting the lubrication is returned to the bottom oil reservoir 14 through an oil passage 19 defined on the periphery of the motor M, via an oil return passage 23 formed in the housing 2.

By the movable scroll 7 being driven to orbitally revolve relative to the fixed scroll 3, the volume of the compression chamber 15 defined between the spiral members 32, 72 is varied, by which low-pressure gas sucked in through the suction pipe 12 connected to the fixed scroll 3 through the casing 1 is introduced between the spiral members 32, 72, and compressed in the compression chamber 15. Then, high-pressure gas discharged through the discharge port 73 of the movable scroll 7 into the discharge gas passage 74 of the cylindrical portion 75 is fed to the discharge gas passage 42 of the drive shaft 4, and thereafter discharged to the second space 62 through an unshown hole. The gas is further passed through an air gap 10 of the motor M so as to be fed to the first space 61, and thereafter discharged out of the casing 1 via the discharge pipe 11.

With the construction described above, in this embodiment, the drive shaft 4 of the motor M disposed within the closed casing 1 of a high-pressure dome, and the movable scroll 7 of the compression section CF to be driven by the drive shaft 4 are provided with the discharge gas passages 74, 42 for discharging, into the casing 1, compressed fluid compressed in the compression chamber 15 of the compression section CF, while the oil feed passage 43 for oil pumped up from the oil reservoir 14 at the bottom of the casing 1 is defined in the drive shaft 4 so as to be partitioned from the discharge gas passage 42. Therefore, heat exchange between discharge gas flowing through the discharge gas passage 42 and oil flowing through the oil feed passage 43 is carried out so that the oil within the oil feed passage 43 to be fed to the sliding portions such as the bearings 21, 91 can be successfully cooled by the discharge gas within the discharge gas passage 42. Still, since the discharge gas passage 42 and the oil feed passage 43 are defined so as to be partitioned from each other, any disturbance of oil due to discharge gas can be prevented so that the cooling of oil can be accomplished successfully without causing any oil rise.

Further, since heat exchange between discharge gas and oil is successfully carried out, the temperature difference between discharge gas temperature and oil temperature can be minimized so that the state of oil can be determined based on the discharge gas temperature. Thus, the control of oil temperature is facilitated.

When a large quantity of refrigerant is mixed in low-temperature oil, for example, at a start of the compressor, the oil within the oil feed passage 43 is heated by the discharge gas flowing through the discharge gas passage 42. Therefore, gas can be separated from the oil by a heating process before the oil is fed to the lubricating portions, so that the viscosity of oil can be increased and thus the lubrication performance can be increased.

Further, the discharge gas passage 42 is provided so as to be eccentric with respect to the axis of the drive shaft 4, in the eccentric direction of the movable scroll 7. Accordingly, in this case, the discharge gas passage 42 is provided in such a direction that any imbalance of the movable scroll 7 is canceled. Therefore, the balance weight provided to the drive shaft 4 may be smaller than the conventional, so that the compressor can be designed to be lighter in weight.

Further, the discharge pipe 11 is opened to the first space 61 defined between the compression section CF and the motor M, while the discharge gas passage 42 is opened to the second space 62 defined on a side of the motor M opposite to the side on which the compression section is provided. Therefore, before discharge gas discharged from the discharge gas passage 42 is discharged out of the casing 1 through the discharge pipe 11, the discharge gas is passed through the air gap 10 of the motor M so that the motor M can be cooled aggressively. Still, the oil in the discharge gas can be separated by the cooling of the motor M, so that the oil rise can be prevented further successfully.

Also since the compression section CF is disposed in the low-pressure side chamber 5, the whole compression section CF is thermally insulated by the low-pressure gas so that suctional overheating is prevented. Thus, a high volumetric efficiency is attained.

INDUSTRIAL FIELD OF APPLICATION

The high-pressure dome type compressor of the present invention is used for refrigerators, air conditioners, and the like.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A high-pressure dome type compressor in which a compression section having a fixed scroll and a movable scroll as well as a motor having a drive shaft for driving the movable scroll of the compression section are disposed in a closed casing, comprising:

discharge gas passages for discharging, into the closed casing compressed gas compressed in a compression chamber of the compression section are defined in the movable scroll and the drive shaft, respectively, and an oil feed passage for oil pumped up from an oil reservoir located at a bottom of the closed casing is defined in the drive shaft so as to be partitioned from the discharge gas passage, said oil feed passage extending generally along an entire length of said drive shaft.

2. The high-pressure dome type compressor as claimed in claim 1, wherein the discharge gas passage of the draft shaft is provided so as to be eccentric with respect to an axis of the drive shaft in an eccentric direction of the movable scroll driven by the drive shaft.

3. The high-pressure dome type compressor as claimed in claim 1, wherein a discharge pipe is opened to a first space defined between the compression section and the motor while the discharge gas passage of the drive shaft is opened to a second space defined on a side of the motor opposite to a side of the motor on which the compression section is provided.

4. The high-pressure dome type compressor as claimed in claim 2, wherein a discharge pipe is opened to a first space defined between the compression section and the motor while the discharge gas passage of the drive shaft is opened to a second space defined on a side of the motor opposite to a side of the motor on which the compression section is provided.

5. The high-pressure dome type compressor as claimed in claim 1, wherein said oil feed passage extends in parallel to said discharge gas passages.

6. The high-pressure dome type compressor as claimed in claim 1, further comprising a communicating member located between the discharge gas passage defined in the movable scroll and the discharge gas passage defined in the drive shaft, said communicating member for communicating the discharge gas passages to each other.

7. The high-pressure dome type compressor as claimed in claim 6, said communicating member further comprising:

a seal member;

a sliding bushing for sliding in contract with said seal member; and a coil spring for urging the seal member against the sliding bushing.

8. The high-pressure dome type compressor as claimed in claim 1, further comprising an oil pump for positively pumping oil from the oil reservoir to the oil feed passage.

9. The high-pressure dome type compressor as claimed in claim 1, wherein said compression section is located at a side of said closed casing opposite to said oil reservoir.

* * * * *